US008434617B1

(12) United States Patent
Wang

(10) Patent No.: US 8,434,617 B1
(45) Date of Patent: May 7, 2013

(54) TOOLBOX

(76) Inventor: Tzu-Chien Wang, Tainan (TW)

( * ) Notice: Subject to any disclaimer, the term of this patent is extended or adjusted under 35 U.S.C. 154(b) by 3 days.

(21) Appl. No.: 13/291,034

(22) Filed: Nov. 7, 2011

(51) Int. Cl.
*B65D 85/28* (2006.01)

(52) U.S. Cl.
USPC ..... 206/372; 206/524.3; 220/783; 220/62.11; 220/62.19

(58) Field of Classification Search ..... 206/372, 206/524.3; 224/269; 220/783, 62.11, 62.19
See application file for complete search history.

(56) References Cited

U.S. PATENT DOCUMENTS 3,916,804 A * 11/1975 Noone ..... 109/78
4,707,005 A * 11/1987 Dyson ..... 292/332
4,708,259 A * 11/1987 Olimpio ..... 220/790
6,698,608 B2 * 3/2004 Parker et al. ..... 220/4.22
7,774,864 B2 * 8/2010 Carlson ..... 2/249

* cited by examiner

*Primary Examiner* — J. Gregory Pickett
*Assistant Examiner* — Blaine Neway

(57) ABSTRACT

A toolbox includes a body and a cover. The body includes a rigid base layer and an external layer. The base layer includes a compartment having an opening. An annular wall is formed on a top face surrounding the opening. The external layer is made of soft, compressible material. The external layer is integrally formed with a portion of an outer face of the base layer and the annular wall as a single, monolithic, inseparable piece. The external layer has an annular ridge corresponding to the annular wall. The cover is made of rigid material and includes a covering face. When the cover is in the closed position, the rigid covering face of the cover covers the annular wall of the body, and the rigid covering face of the cover presses against and sealingly engages with the annular ridge of the body.

4 Claims, 6 Drawing Sheets

TOOLBOX

BACKGROUND OF THE INVENTION

The present invention relates to a toolbox and, more particularly, to a toolbox having enhanced sealing effect between a body and a cover.

Conventional toolboxes generally include a rigid body and a rigid cover that can enclose the body to prevent loss of tools received in the body. However, the sealing effect at the contact sections of the body and the cover is not satisfactory such that water is liable to enter the body, causing rusting of the tools.

FIG. 6 shows a conventional toolbox with waterproof structure. Specifically, the waterproof toolbox includes a rigid body 1', a rigid cover 2', and a seal 3' made of soft material. The cover 2' is mounted to the body 1' and pivotable between an open position and a closed position. The body 1' includes an annular groove 11' in a top face thereof for receiving the seal 3'. An inner face of the cover 2' in the closed position abuts the seal 3' to provide sealing effect and waterproof effect.

However, gaps may exist between the seal 3' and the wall defining the annular groove 11', adversely affecting the waterproof effect. Furthermore, the seal 3' is liable to disengage from the annular groove 11', particularly when the body 1' is subjected to impact.

BRIEF SUMMARY OF THE INVENTION

An objective of the present invention is to provide a toolbox with enhanced waterproof effect.

A toolbox according to the present invention includes a body and a cover. The body includes a base layer and an external layer. The base layer is made of rigid material and includes a compartment having an opening. An annular wall is formed on a top face surrounding the opening. The external layer is made of soft, compressible material. The external layer is integrally formed with a portion of an outer face of the base layer and the annular wall as a single, monolithic, inseparable piece. The external layer has an annular ridge corresponding to the annular wall. The cover is movable between a closed position covering the opening of the body and an open position not covering the opening. The cover is made of rigid material and includes a covering face.

When the cover is in the closed position, the rigid covering face of the cover covers the annular wall of the body, and the rigid covering face of the cover presses against and sealingly engages with the annular ridge of the body.

Preferably, the covering face of the cover includes an insertion groove. The annular ridge of the body is received in the insertion groove when the cover is in the closed position.

Preferably, the external layer of the body includes a first stepped portion corresponding to the annular wall. The first stepped portion includes first and second step faces and a first lateral face between the first and second step faces. The annular ridge is located above the first step face. The covering face of the cover includes a second stepped portion. The second stepped portion includes third and fourth step faces and a second lateral face between the third and fourth step faces. The fourth step face is located above the third face when the cover is in the closed position. When the cover is in the closed position, the second stepped portion engages with the first stepped portion, the rigid third and fourth step faces and the rigid second lateral face press against the soft first and second step faces and the soft first lateral face, respectively.

Preferably, the cover includes an inner layer and an outer layer. The inner layer is made of rigid material and includes the covering face. The cover further includes an engagement section. The outer layer of the cover is made of soft material. The outer layer is integrally formed with a portion of an outer surface of the inner layer as a single, monolithic, inseparable piece. The covering face and the engagement section of the cover are free of the external layer. The body includes an engagement portion free of the soft external layer. The engagement section of the cover is engaged with the engagement portion of the body when the cover is in the closed position.

A clip member can be engaged with the body. The clip member is made of rigid material and includes a clamping section. The clip member further includes a coupling face having a protrusion. The base layer of the body includes a bulge on a bottom face thereof. The bulge includes a through-hole in which the protrusion of the clip member is engaged. The bulge further includes a plurality of guiding grooves extending from an outer periphery of the bulge to the through-hole. An annular protrusion is formed on a bottom of the bulge and located adjacent to an outer peripheral edge of the through-hole. The coupling face of the clip member presses against and engages with the annular flange when the protrusion of the clip member engaged in the through-hole of the bulge.

The present invention will become clearer in light of the following detailed description of illustrative embodiments of this invention described in connection with the drawings.

DETAILED DESCRIPTION OF THE INVENTION

Figure 1:
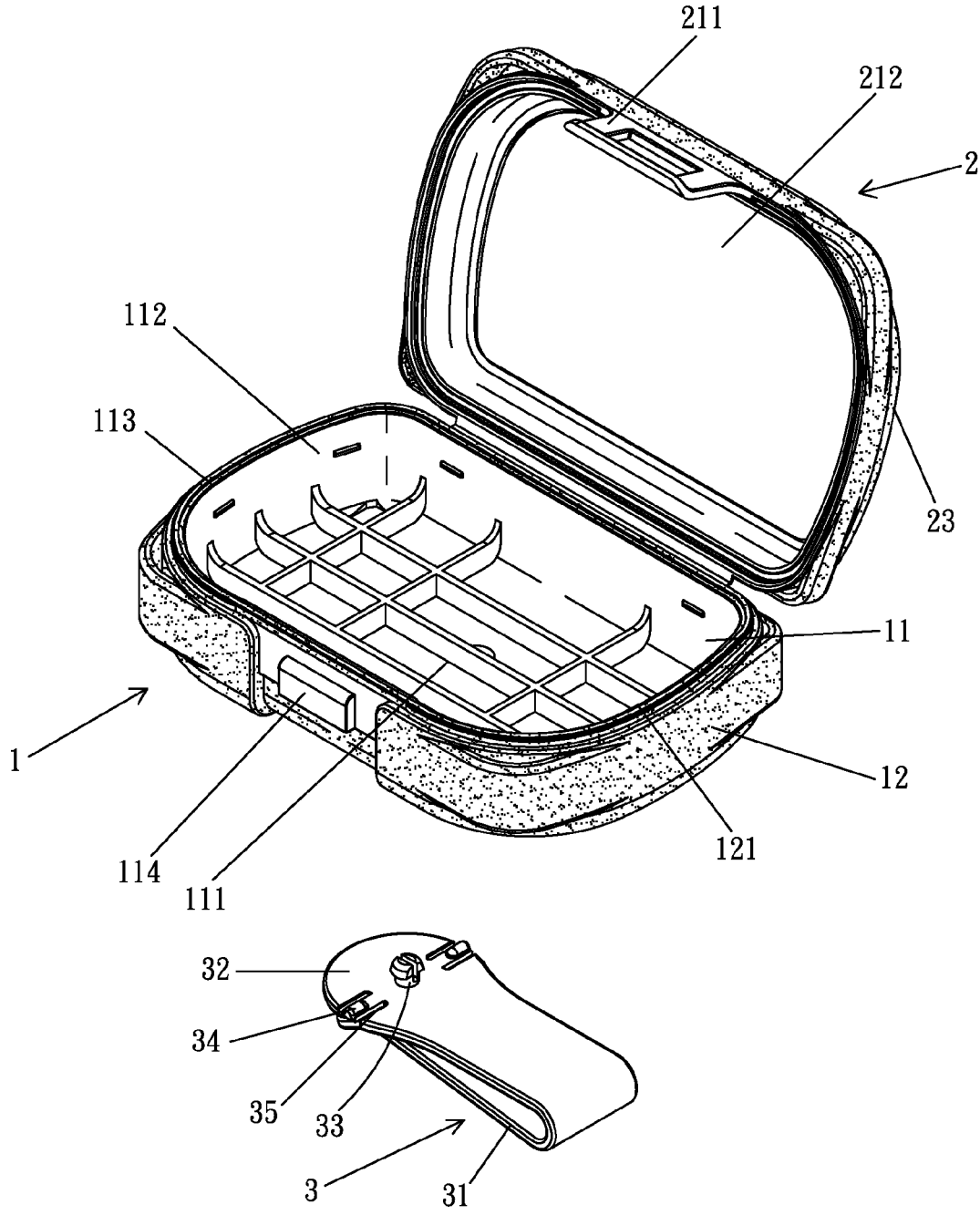
FIG. 1 shows an exploded, perspective view of a toolbox according to the present invention, with a cover of the toolbox opened.
Figure 2:
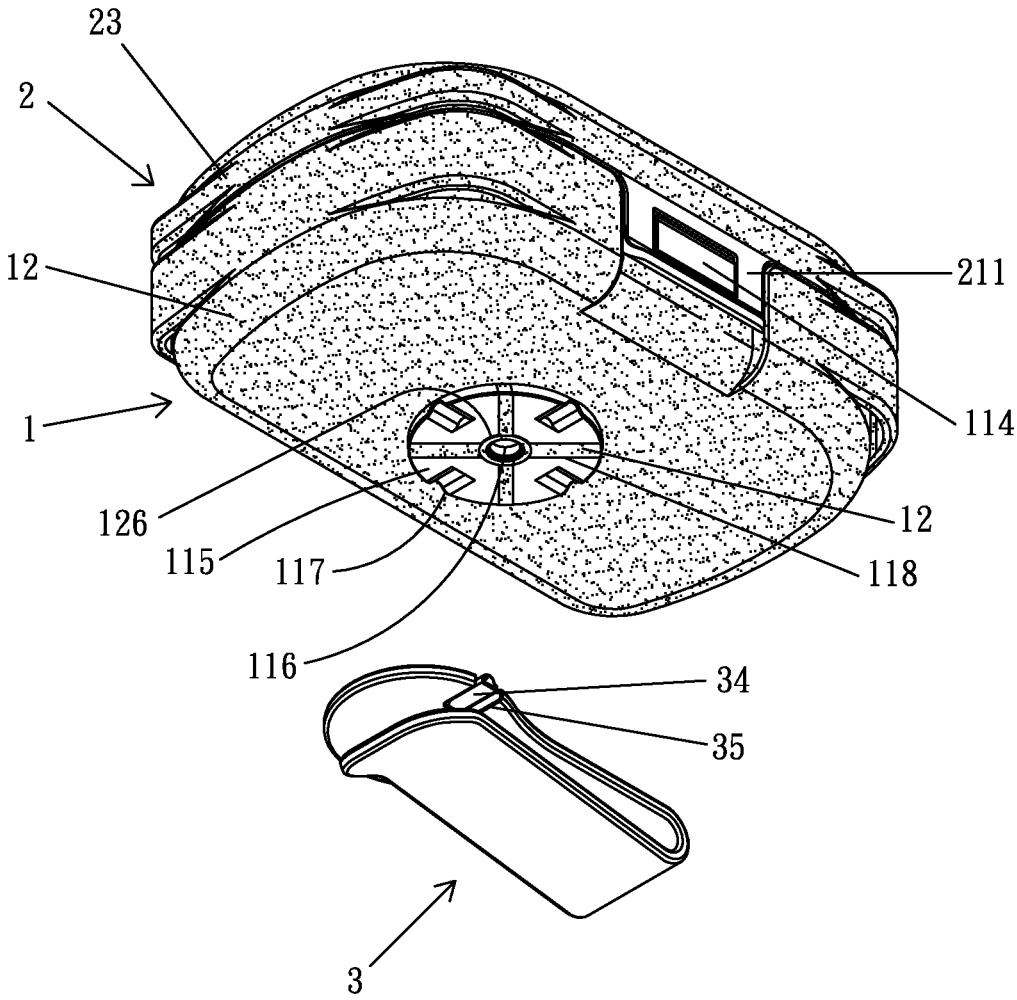
FIG. 2 shows another exploded, perspective view of the toolbox of FIG. 1, with the cover closed.
Figure 3:
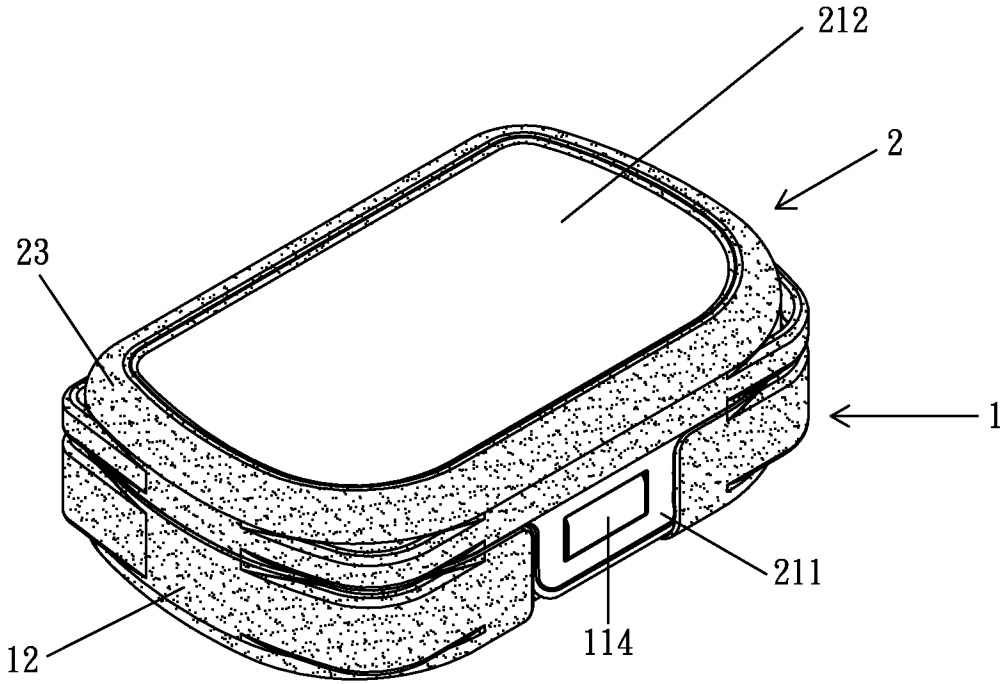
FIG. 3 shows a perspective view of the toolbox of FIG. 1, with the cover closed.
Figure 4:
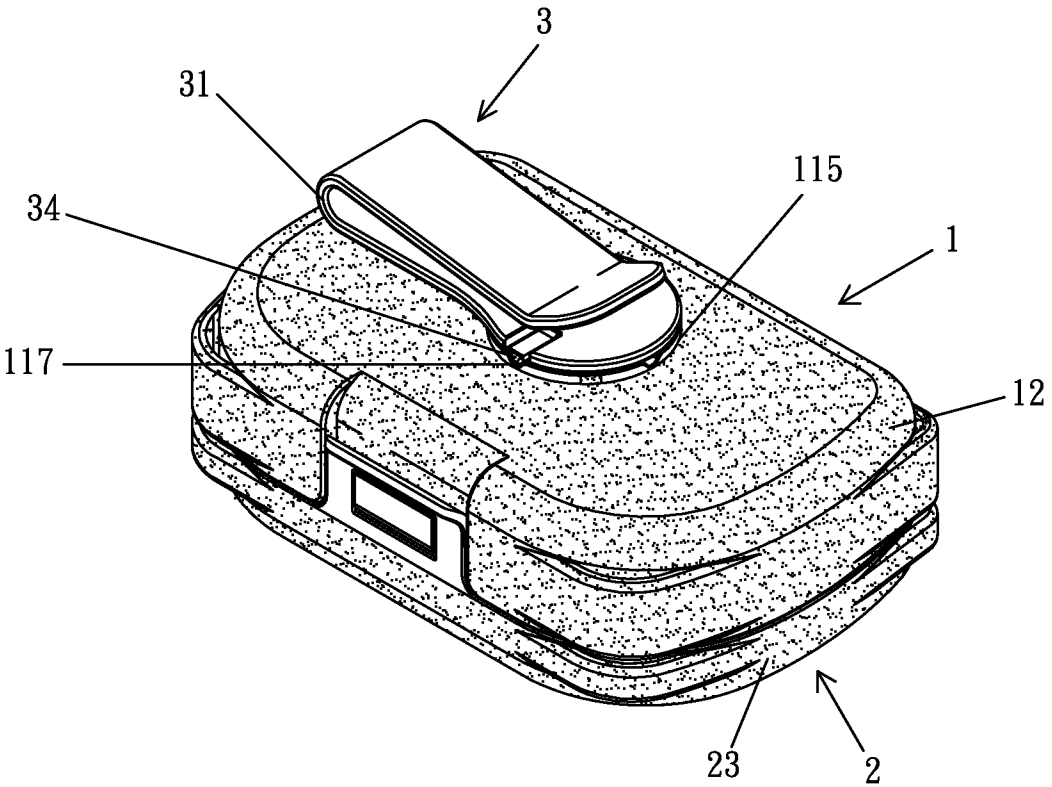
FIG. 4 shows another perspective view of the toolbox of FIG. 3.

With reference to FIGS. 1-5, a toolbox according to the present invention includes a body 1, a cover 2, and a clip member 3. The body 1 includes a base layer 11 and an external layer 12. The base layer 11 is made of rigid material and includes a compartment 111 having an opening 112 in an upper end thereof. An annular wall 113 is formed on a top face surrounding the opening 112. The base layer 11 further includes an engagement portion 114 on an outer periphery thereof. A bulge 115 is formed on a bottom face of the base layer 11 and includes a through-hole 116, a positioning groove 117 surrounding the through-hole 116, and a plurality of guiding grooves 118 each extending from the positioning groove 117 to the through-hole 116. The external layer 12 is made of soft, compressible material. The external layer 12 envelopes and is integrally formed with a portion of an outer face of the base layer 11 and the annular wall 113 as a single, monolithic, inseparable piece by second injection molding, with the engagement portion 114 and the bulge 115 free of the external layer 12.

Figures 5, 5A, 5B:
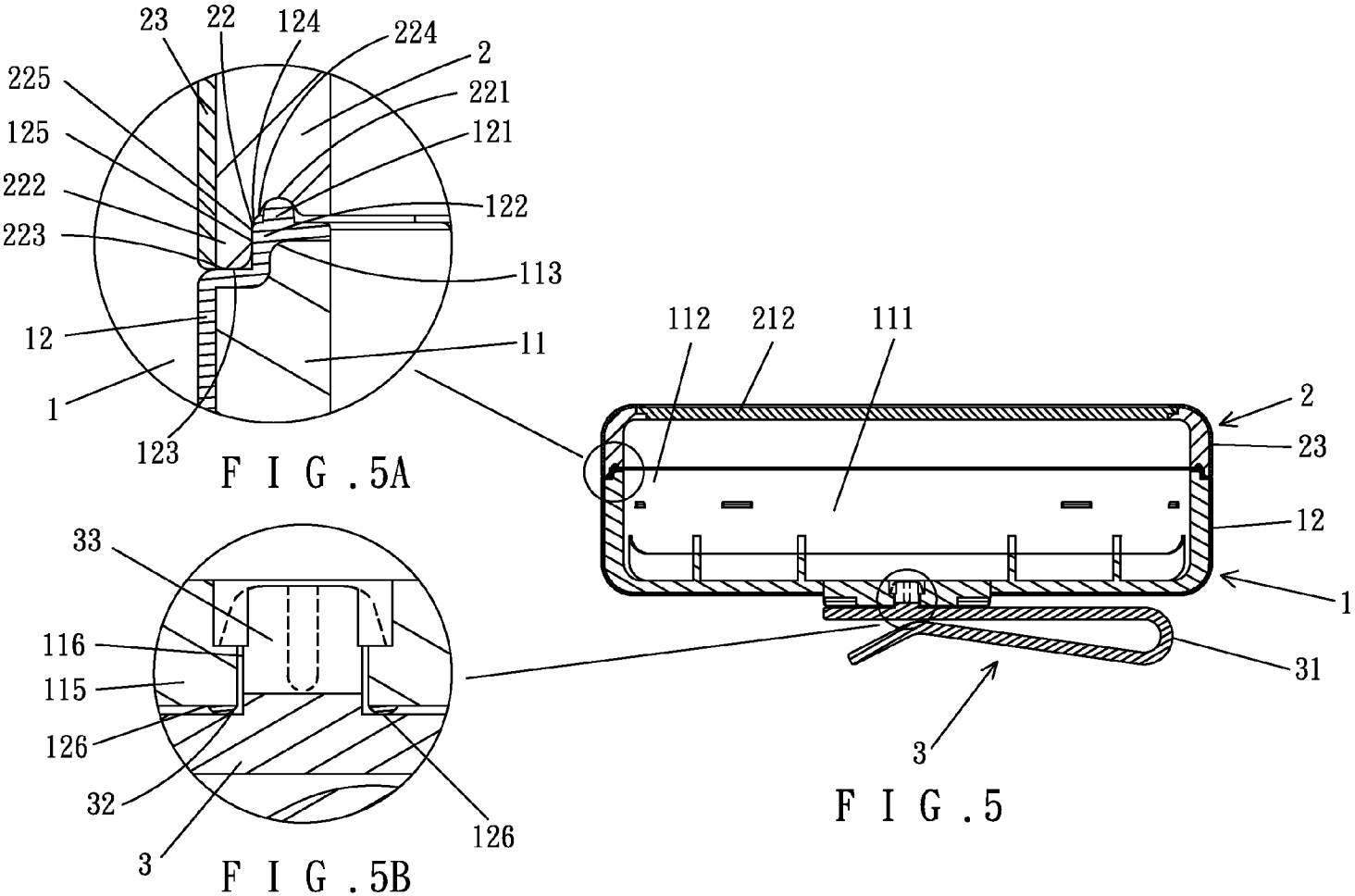
FIG. 5 shows a cross sectional view of the toolbox of FIG. 3.
FIG. 5A shows an enlarged view of a circled portion of FIG. 5.
FIG. 5B shows an enlarged view of another circled portion of FIG. 5.
Figure 6:
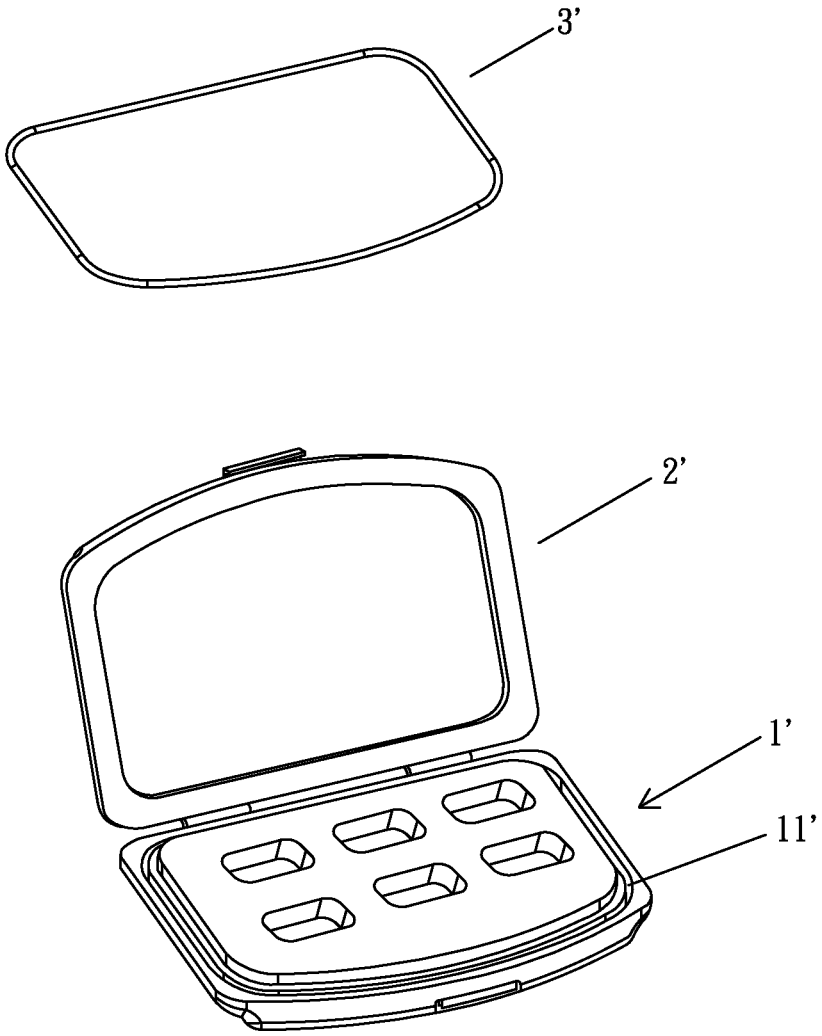
FIG. 6 shows an exploded, perspective view of a conventional waterproof toolbox.

With reference to FIG. 5A, the external layer 12 includes an annular ridge 121 corresponding to the annular wall 113. The external layer 12 further includes a first stepped portion 122 corresponding to the annular wall 113. The first stepped portion 122 includes a first step face 123, a second step face 124 above the first step face 123, and a first lateral face 125 between the first and second step faces 123 and 124. The annular ridge 121 is located above the first step face 123. When the material for forming the soft external layer 12 of the body 1 is taking shape and joining the base layer 11, the material for forming the external layer 12 extends from the guiding grooves 118 to the through-hole 116. Furthermore, an annular protrusion 126 is formed on a bottom of the bulge 115 and located adjacent to an outer peripheral edge of the through-hole 116 (FIG. 5B).

The cover 2 includes an inner layer 21 and an outer layer 23. The inner layer 21 is made of rigid material and includes an end connected to the base layer 11 of the body 1. The cover 2 is moveable between an open position not covering the opening 112 and a closed position covering the opening 112. The cover 2 includes a covering face 22 corresponding to the annular wall 113. The covering face 22 includes an insertion groove 221 corresponding to the annular ridge 121. The inner layer 21 includes an engagement section 211 for coupling with the engagement portion 114 of the cover 1. The cover 2 further includes a transparent lid 212.

With reference to FIG. 5A, the rigid covering face 22 of the cover 2 includes a second stepped portion 222 corresponding to the first stepped portion 122 of the body 1. The second stepped portion 222 includes a third step face 223, a fourth stepped face 224, and a second lateral face 225 between the third and fourth step faces 223 and 224. The fourth stepped face 224 is located above the third step face 223 when the cover 2 is in the closed position. The outer layer 23 is made of soft material. The outer layer 23 envelopes and is integrally formed with a portion of an outer face of the inner layer 21 as a single, monolithic, inseparable piece by second injection molding, with the engagement section 211 free of the outer layer 23. Thus, the engagement portion 114 of the body 1 and the engagement section 211 of the cover 2 can be reliably engaged with each other.

The clip member 3 is made of rigid material and includes a clamping section 31 for engagement with such as a belt of a user. The clip member 3 further includes a coupling face 32 having a protrusion 33 for engagement with the through-hole 116 and projections 34 for engagement with the positioning groove 117. Each protrusion 34 includes slits 35 to provide flexibility.

When the rigid covering face 22 of the cover 2 covers the annular wall 113 of the body 1, the covering face 22 presses against the soft annular ridge 121 to provide enhanced sealing effect. The annular ridge 121 is received in the insertion groove 221 of the covering face 22 to provide further enhanced sealing effect. Furthermore, when the cover 2 covers the body 1, the rigid second stepped portion 222 engages with the soft first stepped portion 122. Further, the rigid third and fourth step faces 223 and 224 and the rigid second lateral face 225 press against and firmly engage with the soft first and second step faces 123 and 124 and the first lateral face 125, respectively.

When the protrusion 33 engages with the through-hole 116 of the body 1, the coupling face 32 of the clip member 3 presses against the soft annular protrusion 126 of the body 1 to provide enhanced sealing effect while preventing leakage of water through the through-hole 116. The clip member 3 allows easy carriage of the toolbox.

Since the annular ridge 121 and the first stepped portion 122 of the body 1 are made of the same material as the external layer 12 of the body 1, enhanced reliability is provided. Namely, the annular ridge 121 will not fall when the cover 2 is moved relative to the body 1. Furthermore, the annular protrusion 126 is also integrally formed with the external layer 12 as a single, monolithic, inseparable piece, providing enhanced reliability and enhanced waterproof effect. Ambient water can be reliably prevented from entering the compartment 111 of the body 1, avoiding rusting of the tools received in the body 1 and prolonging the service life of the tools. Furthermore, the external layer 12 is made of soft material to provide enhanced shock-absorbing effect and to provide comfort to the touch.

The cover 2 does not have to include the outer layer 23 while providing the desired waterproof effect. In a case that the body 1 does not include the first stepped portion 122 of the body 1 and the cover 2 does not include the second stepped portion 222, the annular ridge 121 of the body 1 and the covering face 22 of the cover 2 can provide the desired waterproof effect and reliability. Furthermore, the toolbox does not have to include the clip member 3 and the through-hole 116.

Although specific embodiments have been illustrated and described, numerous modifications and variations are still possible without departing from the essence of the invention. The scope of the invention is limited by the accompanying claims.

The invention claimed is:

1. A toolbox comprising:

a body including a base layer and an external layer, with the base layer made of rigid material and including a compartment having an opening, with an annular wall formed on a top face surrounding the opening, with the external layer made of soft, compressible material, with the external layer integrally formed with a portion of an outer face of the base layer and the annular wall as a single, monolithic, inseparable piece, with the external layer having an annular ridge connecting a first stepped portion and corresponding to the annular wall; and a cover movable between a closed position covering the opening of the body and an open position not covering the opening, with the cover made of rigid material, with the cover including a rigid covering face, wherein with the cover in the closed position, the rigid covering face of the cover covers the annular wall of the body, and the rigid covering face of the cover presses against and sealingly engages with the annular ridge of the body, with the external layer of the body including the first stepped portion corresponding to the annular wall, with the first stepped portion including a first step face and a second step face and a first lateral face between the first step face and the second step face, with the annular ridge located above the first step face, with the covering face of the cover including a second stepped portion, with the second stepped portion including a third and a fourth step face and a second lateral face between the third step face and the fourth step face, with the fourth step face located above the third step face when the cover is in the closed position, with the cover in the closed position, the second stepped portion engages with the first stepped portion, the third step face and the fourth step face and the second lateral face press against the first step face and the second step faces and the first lateral face, respectively.

2. The toolbox as claimed in claim 1, with the covering face of the cover including an insertion groove, with the annular ridge of the body received in the insertion groove when the cover is in the closed position.

3. The toolbox as claimed in claim 1, with the cover including an inner layer and an outer layer, with the inner layer made of rigid material and including the covering face, with the cover further including an engagement section, with the outer layer of the cover made of soft material, with the outer layer integrally formed with a portion of an outer surface of the inner layer as a single, monolithic, inseparable piece, with the covering face and the engagement section of the cover free of the external layer, with the body including an engagement portion free of the soft external layer, with the engagement section of the cover engaged with the engagement portion of the body when the cover is in the closed position.

4. The toolbox as claimed in claim 1, further comprising: a clip member engaged with the body, with the clip member made of rigid material and including a clamping section, with the clip member further including a coupling face having a protrusion, with the base layer of the body including a bulge on a bottom face thereof, with the bulge including a through-hole, with the protrusion of the clip member engaged in the through-hole, with the bulge further including a plurality of guiding grooves extending from an outer periphery of the bulge to the through-hole, with an annular protrusion formed on a bottom of the bulge and located adjacent to an outer peripheral edge of the through-hole, with the coupling face of the clip member pressing against and engaged with the annular flange when the protrusion of the clip member engaged in the through-hole of the bulge.

* * * * *